United States Patent [19]

Molyneux-Berry

[11] 4,081,719

[45] Mar. 28, 1978

[54] DOUBLE ENDED THYRATRON WITH TRIGGER IMPULSE MEANS

[75] Inventor: Robert Bewes Molyneux-Berry, Chelmsford, England

[73] Assignee: English Electric Valve Company Limited, England

[21] Appl. No.: 765,051

[22] Filed: Feb. 2, 1977

[30] Foreign Application Priority Data

Feb. 3, 1976 United Kingdom ..... 4113/76

[51] Int. Cl.[2] ..... H01J 17/12; H01J 17/54

[52] U.S. Cl. ..... 315/350; 315/354

[58] Field of Search ..... 315/349–351, 315/354, 341, 342

[56] References Cited

U.S. PATENT DOCUMENTS 3,898,518 8/1975 Menown et al. ..... 315/350

*Primary Examiner*—Alfred E. Smith

*Assistant Examiner*—Charles F. Roberts

*Attorney, Agent, or Firm*—Diller, Brown, Ramik & Wight

[57] ABSTRACT

The invention provides a double ended thyratron arrangement in which at each end of the thyratron there is a cathode, at least one intermediate grid and a final grid which borders a high voltage withstanding gap. At each end of the thyratron the final grid which borders a high voltage gap is connected to act as a screen electrode, usually by connecting this grid directly to the cathode. At the same time, at one or both ends of the thyratron means are provided for applying triggering input pulses to one of the intermediate grids between the respective cathode and final grid. The thyratron may be of the pentode type, in which case, at each end the final grid is connected to act as a screen, the intermediate grid adjacent the cathode is subject to bias and the triggering signals are applied to the intermediate grid adjacent the final grid.

8 Claims, 3 Drawing Figures

DOUBLE ENDED THYRATRON WITH TRIGGER IMPULSE MEANS

This invention relates to thyratron arrangements and more specifically to such arrangements utilising double-ended thyratrons.

Double-ended thyratrons form the subject of U.K. Pat. No. 1,334,527 and are described in a paper entitled "A Multigap Double-Ended Hydrogen Thyratron" presented by H. Menown and P. B. Newton at the Eleventh Modulator Symposium, September, 1973.

Figure 1:
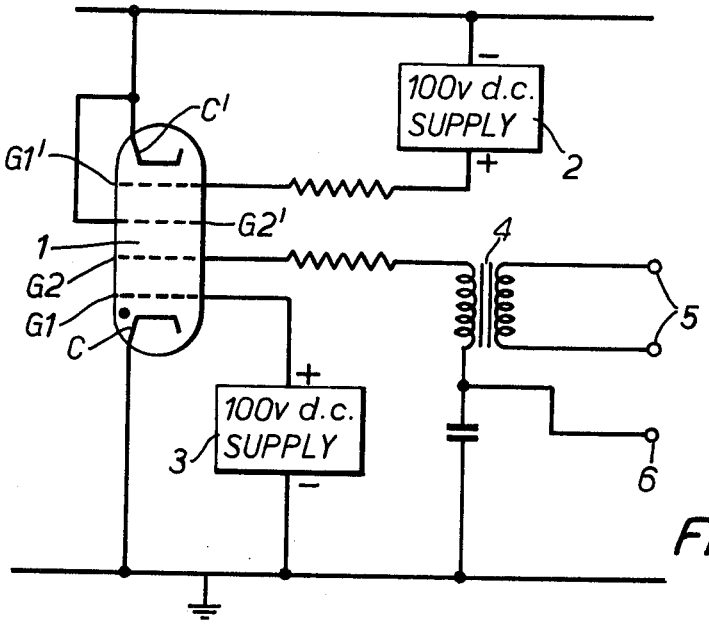
FIG. 1 is an illustration of a conventional double-ended hydrogen thyratron of the tetrode type.

A conventional double-ended hydrogen thyratron arrangement is illustrated in FIG. 1 of the accompanying drawings. In this case the thyratron is of the tetrode type.

Referring to FIG. 1, the hydrogen thyratron consists of a cathode C, a first grid G1 and a final grid G2 at one end of the tube. At the other end of the tube is a similar structure consisting of a cathode C', a first grid G1' and a final grid G2'. Between final grids G2 and G2' is a high voltage gap 1. The tube is arranged with one of its cathodes C functioning as a cathode whilst the other of its cathodes C' functions as an anode. Grid G2' is connected to cathode C' in order to act as a screening electrode, whilst G1' is connected to a 100V d.c. bias supply 2.

At the other end of the tube grid G1 is connected to a 100V d.c. bias supply 3, whilst grid G2 is connected, via a transformer 4, to a source of trigger pulses represented by the terminals 5. In addition, a negative bias of 150V magnitude is applied to grid G2 via the secondary winding of transformer 4 from a terminal 6. The purpose of the negative bias applied to grid G2 via the terminal 6 is to maintain voltage hold-off and reduce dark current.

The present invention seeks to provide an improved double-ended thyratron arrangement.

According to this invention a double-ended thyratron arrangement includes a double-ended thyratron in which, at both ends, the final grid which borders a high voltage gap is connected to act as a screen electrode and, at one or both ends, means are provided for applying triggering input pulses to an intermediate grid between the cathode and the aforementioned final grid.

Preferably said final grid is connected directly to said cathode.

Said thyratron may be of the pentode type having, at each end, two grids between a cathode and a voltage withstanding gap.

In one embodiment of the invention, means are provided for applying bias and triggering input pulses to said intermediate grid.

In one arrangement in accordance with the present invention said means for applying bias and triggering input pulses comprises, for one or both ends of said thyratron, means for applying a sequence of bias levels and triggering input pulses in which series said intermediate grid is biassed to a potential positive with respect to said cathode and said final grid to provide a relatively low bias current causing said cathode to be surrounded with protective plasma whilst said thyratron is held-off from conduction, a trigger pulse of relatively high current is applied to said intermediate grid to turn said thyratron on, said intermediate grid is biassed to a potential positive with respect to said cathode and said final grid to provide an intermediate level of bias current tending to maintain said thyratron on and said intermediate grid is biassed to a potential approximating to that of said cathode and said final grid in order to turn said thyratron off.

Said arrangement may be such that, in operation, said thyratron is triggered simultaneously at both ends, but if not normally the arrangement is such that to the intermediate grid at the end of the thyratron which is not triggered bias is applied to produce said relatively low bias current.

Typically, said relatively low bias current is of the order of tens of milliamps, said relatively high current is of the order of amps and tens of amps and said intermediate level of bias current is of the order of hundreds of milliamps.

According to a feature of this invention said double-ended thyratron includes at both ends three grids, the final ones of which, bordering a high voltage gap, are connected to act as screen electrodes and the first ones of which, each adjacent a respective cathode, are connected to receive protective bias, and wherein, at one or both ends, means are provided for applying triggering input pulses to the intermediate grid between said first and said final electrodes.

The invention is illustrated in and further described with reference to FIG. 2 of the accompanying drawing in which like references are used for like parts in FIG. 1, and with reference to the accompanying drawing, the single figure of which is numbered 3 to follow naturally the figures in the drawing which accompanied the provisional specification.

Referring to FIG. 2, as will be seen, again the thyratron is a double-ended hydrogen thyratron of the tetrode type. Both final grid G2 and final grid G2' are connected directly to their respective cathodes C and C', so as to act as screening electrodes. Grid G1 is connected via transformer 4 to trigger pulses input terminals 5 and, via the primary of transformer 4, to a terminal 7 to which bias may be applied. Similarly, grid G1', is connected via a transformer 4 to two terminals 5' to which triggering pulses may be applied, and, via the primary of transformer 4', to a terminal 7' to which bias may be applied. With this arrangement the thyratron may be triggered for conduction in either direction in dependence upon to which of the pairs of terminals 5 and 5' triggering pulses are applied.

Whichever of the pairs of terminals 5 and 5' is arranged to have triggering pulses applied thereto the associated bias terminal 7 or 7' is arranged to have a sequence of bias levels applied thereto as follows:

Firstly, prior to triggering, a level of bias termed protective bias.

Secondly, following triggering, a level of bias termed hold-on bias and

Thirdly a level of bias termed zero or turn-off bias effective to cause conduction to cease. Following the application of turn-off bias, protective bias is re-applied. Both ends of the thyratron may be triggered simultaneously, but if not then at the same time as trigger pulses are applied to one of the pairs of terminals 5 or 5', protective bias is applied to the opposite bias terminal 7′ or 7 respectively.

The level of bias known as zero or turn-off bias is that level of bias achieved when the intermediate grid G1 or G1′ is at the same potential as the respective cathode and final grid C, G2 or C′, G2′. With zero or turn-off bias applied to both intermediate grids G1 and G1′, the high voltage hold-off capability and the low nature of the dark current experienced has been found to be better than that of a conventional arrangement, such as that illustrated in FIG. 1, in which only one cathode is connected to the final grid G2′. This is especially so with a thyratron provided to operate with high gas pressure to improve its output current capability. Under conducting conditions, the holding current (the minimum steady current which the valve will conduct without turning off spontaneously) is relatively high (hundreds of milliamps, according to valve type and gas pressure) and the thyratron turns off if its current falls below this level for a few microseconds, (for example, as occurs upon an oscillatory current reversal). Once turned off, the thyratron will immediately withstand a few kilovolts, rising to the full rated hold-off voltage after some tens of microseconds. As with a conventional thyratron arrangement if this last mentioned voltage is re-applied too soon, the thyratron may be forced back into conduction in a manner which may shorten its life.

With positive bias on grids G1 or G1′ (positive with respect to cathode and final grid C, G2 or C′, G2′ respectively), the gas arc to cathode stabilises at approximately 15 to 30V according to valve type, gas pressure and arc current. The protective bias, hold-on bias and the trigger pulses are forms of positive bias.

The level of bias known as protective bias is that which produces a protective plasma sheath around the respective cathode C or C′ without causing the thyratron to conduct, in other words without unduly degrading hold-off. Typically, the level of bias current in the case of protective bias is of the order of tens of milliamps.

The level of bias known as hold-on bias is that which, with protective bias applied to the opposite intermediate grid, the thyratron will conduct in one direction, but not the other. The maximum bias current which may be continuously applied as hold-on bias is limited by the permissible dissipation of the intermediate grid G1 or G1′ to a level which is insufficient to provide fast turn-on. Typically hold-on bias involves bias currents of the order of hundred of millamps.

So far as the trigger pulses are concerned, conventional thyratron practice may be followed, but it should be noted that in general triggering intermediate grid G1 or G1′ requires a somewhat heavier current pulse than required with the conventional example of FIG. 1. However, because an arrangement in accordance with the present invention does not require negative bias, (as is required in the arrangement of FIG. 1) and because it has been found that spark-traps (necessary on grid G2 in the example of FIG. 2 for high voltage applications) are not required, the circuit arrangement may be much simplified. Typically, trigger pulses of the order of amps and tens of amps would be employed. As has already been mentioned, the thyratron may be triggered at one or other end or at both ends simultaneously. However, when the thyratron is triggered at one end only the intermediate grid G1 or G1′ at the other end should be provided with protective bias.

A thyratron arrangement in accordance with the present invention is of wide application, but is particularly applicable where conduction in either of two directions is a requirement. As with the known double-ended thyratron arrangement, however, it finds application even where conduction in one direction only is required.

Figure 3:
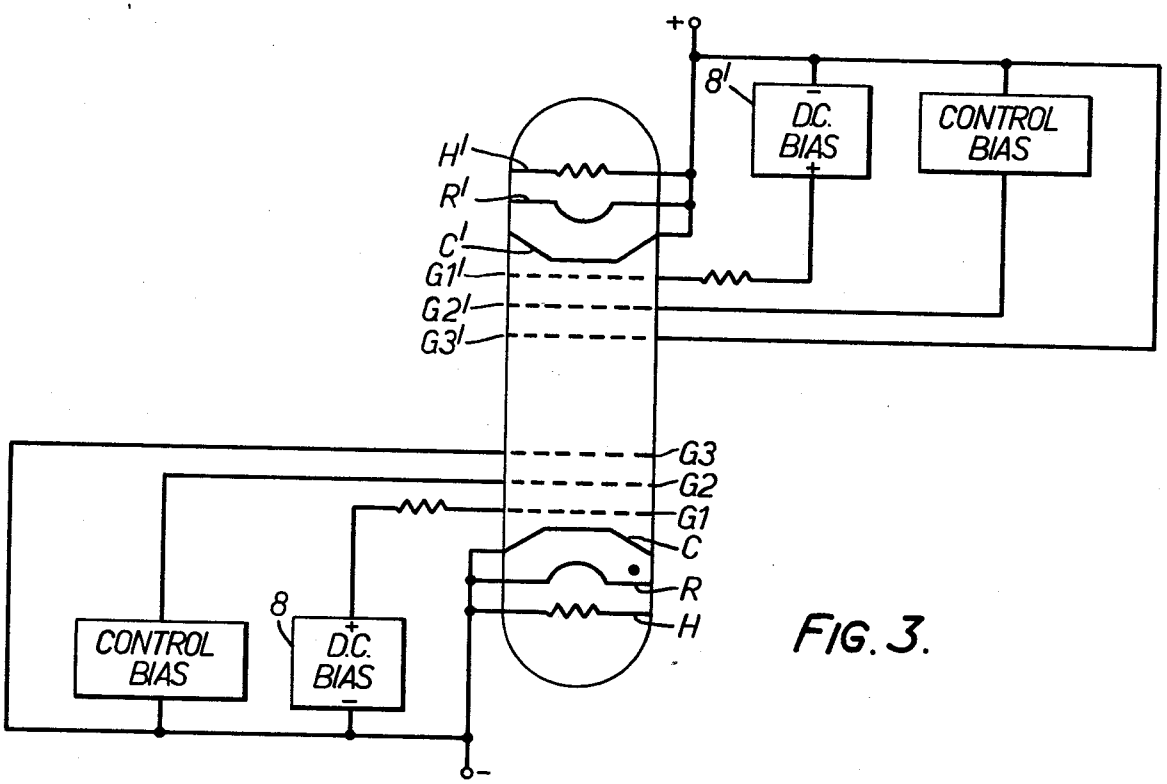
FIG. 3 is an illustration of a double-ended thyratron of the double-ended pentode type.

Referring to FIG. 3, in this case the thyratron 1 is of the double-ended pentode type. At one end of the thyratron is a cathode C having a reservoir R and a heater H. Adjacent the cathode C is a first grid G1. Between the first grid G1 and a final grid G3 is an intermediate grid G2.

At the other end of the tube is a similar structure consisting of cathode C′, cathode reservoir R, cathode heater H, first grid G1, intermediate grid G2 and final grid G3.

Again between final grids G3 and G3′ is a high voltage gap 1.

Figure 2:
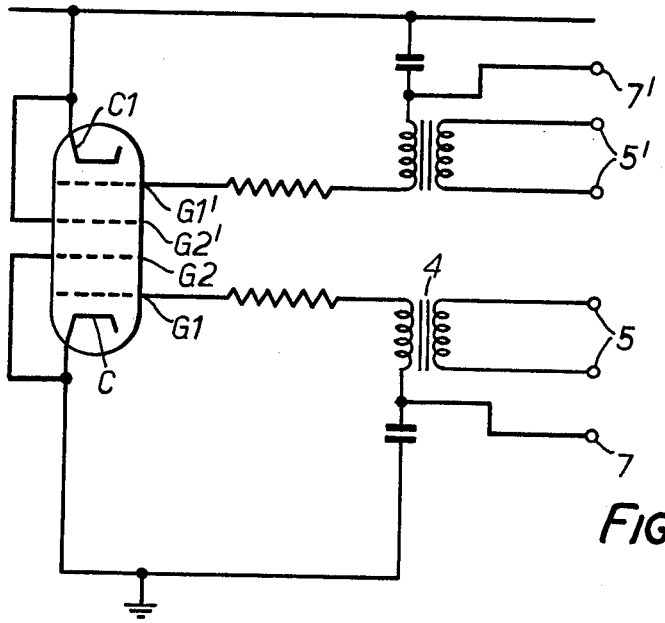
FIG. 2 is an illustration of another arrangement of a double-ended hydrogen thyratron of the tetrode type.

As with the final grids G2 and G2′ of FIG. 2, final grids G3 and G3′ are connected to their respective cathodes C and C′ so as to act as screening grids. Cathode C′ is connected to the one pole of the supply and cathode C is connected to the other pole of the supply.

First grid G1 and first grid G1′ are connected respectively to d.c. bias sources 8 and 8′ which are such that grids G1 and G1′ are energised continuously at protective bias level (as hereinbefore described).

Intermediate grids G2 and G2′ are connected to control bias sources which are controlled to apply control bias to the grids G2 and G2′ independently or simultaneously.

Control is effective at whichever end is, for the time being, more negative in potential. Control at the end which is, for the time being, more positive in potential does not affect the conduction through the valve. Simultaneous application of control bias to grids G2 and G2′ controls the valve irrespective of the instantaneous polarity, and allows a.c. working. Independent control permits working as a diode or switch with polarity selected or altered at will.

It will be noted in connection with the arrangement of FIG. 3 that the application of protective bias on grids G2 or G2′ is not required in view of the fact that protective bias is applied continuously to grids G1 and G1′. Apart from simplifying the control circuits of grids G2 and G2′ (compared to the corresponding circuits of FIG. 2) this ensures that, barring a fault condition, the cathode C or C′ is continuously protected from high energy ions. Furthermore, the thyratron may be triggered with less delay and jitter, somewhat higher levels of protective bias (up to hundreds of milliamps) may be employed without unduly affecting the voltage hold-off of the thyratron and it is relatively convenient to monitor the running voltages of grids G1 and G1′ to provide an indication of correct cathode temperature and gas pressure.

The use of a pentode type thyratron as in FIG. 3 also makes it possible to apply negative bias to grids G2 and G2′ (tens or a few hundreds of volts) which may, even though only slightly, improve the voltage hold-off but should ensure relatively early turn-off and fast recovery when the thyratron current falls to a low value or tries to reverse. It would not normally be practicable to apply negative bias to grid G1 or G1′ since there would be a tendency for grid emission to occur.

Whilst for simplicity only thyratrons having a single voltage withstanding gap have been described, the invention is equally applicable to thyratrons having multiple voltage withstanding gaps. I claim:

1. A double-ended thyratron arrangement including a double-ended thyratron in which, at both ends, the final grid which borders a high voltage gap is connected to act as a screen electrode and, at least at one end, means are provided for applying triggering input pulses to an intermediate grid between the cathode and the aforementioned final grid.

2. An arrangement as claimed in claim 1 and wherein said final grid is connected directly to said cathode.

3. An arrangement as claimed in claim 1 and wherein said thyratron is of the pentode type having, at each end, two grids between a cathode and a voltage withstanding gap.

4. An arrangement as claimed in claim 1 and wherein means are provided for applying bias and triggering input pulses to said intermediate grid.

5. An arrangement as claimed in claim 1 and wherein said means for applying bias and triggering input pulses comprises, for at least one end of said thyratron, means for applying a sequence of bias levels and triggering input pulses in which series said intermediate grid is biassed to a potential positive with respect to said cathode and said final grid to provide a relatively low bias current causing said cathode to be surrounded with protective plasma whilst said thyratron is held-off from conduction, a trigger pulse of relatively high current is applied to said intermediate grid to turn said thyratron on, said intermediate grid is biassed to a potential positive with respect to said cathode and said final grid to provide an intermediate level of bias current tending to maintain said thyratron on and said intermediate grid is biassed to a potential approximating to that of said cathode and said final grid in order to turn said thyratron off.

6. An arrangement as claimed in claim 1 and such that, in operation, said thyratron is triggered simultaneously at both ends.

7. An arrangement as claimed in claim 1 and such that, in operation, one of the ends of said thyratron is triggered, whilst to the intermediate grid at the end of the thyratron which is not triggered bias is applied to produce said relatively low bias current.

8. An arrangement as claimed in claim 1 and wherein said double-ended thyratron includes at both ends three grids the final ones of which, bordering a high voltage gap, are connected to act as screen electrodes and the first ones of which, each adjacent a respective cathode, are connected to receive protective bias, and wherein, at one or both ends, means are provided for applying triggering input pulses to the intermediate grid between said first and said final electrodes.

* * * * *

UNITED STATES PATENT AND TRADEMARK OFFICE

CERTIFICATE OF CORRECTION

PATENT NO. : 4,081,719

DATED : Mar. 28, 1978

INVENTOR(S) : Robert B. Molyneaux-Berry

It is certified that error appears in the above-identified patent and that said Letters Patent are hereby corrected as shown below:

Column 6, line 13, change "1" to ---5---.

Signed and Sealed this

*Twelfth* Day of *September 1978*

[SEAL]

*Attest:*

RUTH C. MASON
*Attesting Officer*

DONALD W. BANNER
*Commissioner of Patents and Trademarks*